US011655628B2

(12) United States Patent
Ghiringhelli

(10) Patent No.: US 11,655,628 B2
(45) Date of Patent: May 23, 2023

(54) DECK LEDGER BOARD SPACING SYSTEM WITH KEYED CENTER BUSHING, COUPLING SPACERS, REINFORCING COUPLER, AND REINFORCED SHIM

(71) Applicant: Joseph James Ghiringhelli, Rohnert Park, CA (US)

(72) Inventor: Joseph James Ghiringhelli, Rohnert Park, CA (US)

( * ) Notice: Subject to any disclaimer, the term of this patent is extended or adjusted under 35 U.S.C. 154(b) by 0 days.

(21) Appl. No.: 17/658,610

(22) Filed: Apr. 8, 2022

(65) Prior Publication Data

US 2022/0333367 A1 Oct. 20, 2022

Related U.S. Application Data

(60) Provisional application No. 63/264,235, filed on Nov. 17, 2021, provisional application No. 63/201,241, filed on Apr. 20, 2021.

(51) Int. Cl.
*E04B 1/00* (2006.01)

(52) U.S. Cl.
CPC ..... *E04B 1/003* (2013.01)

(58) Field of Classification Search
CPC ..... E04B 1/003; E04B 1/34352; E02D 5/80; E02D 27/32; E02D 2220/00
See application file for complete search history.

(56) References Cited

U.S. PATENT DOCUMENTS

| | | | |
|---|---|---|---|
| 899,972 | A | 9/1908 | Hammer |
| 2,058,020 | A | 10/1936 | Jaffe |
| 3,208,135 | A | 9/1965 | Newbold et al. |
| 3,216,171 | A | 11/1965 | Jenkins |
| 3,331,272 | A | 7/1967 | Hanneman |
| D219,768 | S | 1/1971 | Conwell |
| 3,649,079 | A | 3/1972 | English |
| 4,070,845 | A | 1/1978 | Cody |
| 4,165,904 | A | 8/1979 | Reppert |
| 4,412,407 | A | 11/1983 | Melfi et al. |
| 4,526,641 | A | 7/1985 | Schriever et al. |
| 4,793,335 | A | 12/1988 | Frey et al. |
| 4,867,472 | A | 9/1989 | Ward |
| 4,955,813 | A | 9/1990 | Fochler |
| D315,667 | S | 3/1991 | Johnson |
| 5,005,229 | A | 4/1991 | Bertoni |
| 5,108,156 | A | 4/1992 | Bell |
| 5,201,156 | A | 4/1993 | Newman |
| 5,362,134 | A | 11/1994 | Carmona |

(Continued)

*Primary Examiner* — Theodore V Adamos

(57) ABSTRACT

A deck ledger board spacer system that includes a solid disc body having a front side and a rear side, a center hole, and a plurality of circumferential through holes surrounding the center hole. The center hole includes at least one radially-extending void that serves as a female element for a complementary keyed bushing. Each of the front and rear sides have a plurality of wells recessed from the disc body surface, the wells configured to receive a volume of flowable adhesive sealant material during spacer installation. One or more swappable keyed bushings are sized for insertion in the center hole, each of the keyed bushings having a male element complementary to the radially-extending void and having a bushing through hole with a diameter different from other keyed bushings in a plurality of keyed bushings.

11 Claims, 10 Drawing Sheets

(56) References Cited

U.S. PATENT DOCUMENTS

| | | | | |
|---|---|---|---|---|
| 5,454,628 | A | 10/1995 | Maiworm et al. | |
| 5,503,500 | A * | 4/1996 | Oliver | E04B 1/34352 405/230 |
| 5,564,172 | A * | 10/1996 | Klann | B25B 27/304 29/227 |
| 5,888,012 | A | 3/1999 | Nygren et al. | |
| 5,904,461 | A | 5/1999 | McKarge, Jr. | |
| 5,918,707 | A | 7/1999 | Saunders, III | |
| D418,044 | S | 12/1999 | Schoeneweis | |
| D442,197 | S | 5/2001 | Willet | |
| 6,626,502 | B1 * | 9/2003 | Petrak | B60B 3/16 301/9.1 |
| 6,945,004 | B1 * | 9/2005 | Ghiringhelli | E04B 5/12 52/299 |
| D534,064 | S | 12/2006 | Gimpel et al. | |
| 7,827,747 | B2 * | 11/2010 | George | E02D 27/16 52/297 |
| 8,087,207 | B2 | 1/2012 | Ghiringhelli | |
| 8,756,871 | B1 * | 6/2014 | Johnson | E02D 31/02 52/27 |
| 8,898,993 | B2 * | 12/2014 | Rodgers | E04B 1/003 52/289 |
| 10,744,817 | B2 * | 8/2020 | Chen | B60B 3/147 |
| 11,059,586 | B2 * | 7/2021 | Cuddy | B64D 11/003 |
| 2005/0284056 | A1 * | 12/2005 | Ghiringhelli | E04B 1/003 52/289 |
| 2017/0362815 | A1 * | 12/2017 | Brigham | E04F 15/02044 |
| 2019/0218767 | A1 * | 7/2019 | Studer | E04B 1/003 |

* cited by examiner

DECK LEDGER BOARD SPACING SYSTEM WITH KEYED CENTER BUSHING, COUPLING SPACERS, REINFORCING COUPLER, AND REINFORCED SHIM

CROSS REFERENCES TO RELATED APPLICATIONS

The present application claims the benefit of U.S. Provisional Patent Application No. 63/264,235, filed Nov. 17, 2021 and 63/201,241, filed Apr. 20, 2021.

BACKGROUND OF THE INVENTION

Field of the Invention

The present invention relates most generally to building construction materials and, more particularly, to spacers used to secure a ledger board to a structural framing member of a structure to which the deck is attached, and still more particularly to a deck ledger board spacer of the same kind having an exchangeable and selectively-sized keyed center bushing that accommodates fasteners of differing diameters, differentially-sized countersinks on opposing sides of the spacer to accommodate secondary fasteners of differing sizes and shapes, and a plurality of sealant or adhesive recesses on each side of the spacer to accept and constrain a flowable sealant and to receive shear transfer accessories, such as couplers, reinforcing chips, and coupling spacers.

Background Discussion

Prior to the recent adoption of deck building code requirements, deck ledgers were frequently installed with nails. Nails were eventually found to be structurally inadequate for the ledger connection and a major cause for structural failure in decks. Eventually, nails were effectively prohibited by most building codes, which typically require ½" bolts and lag screws at deck ledger connections.

In addition to fastening standards, the current building codes typically call for methods to prevent decay at the connection, as it too is often a contributing cause or factor in ledger failure. Flashing and spacers are known devices employed to prevent wood decay in ledgers and other supporting structures.

The bolts and lags required by building codes provide a secure connection, but they are costly and somewhat cumbersome to install. Because of this, fastener manufacturers developed structural wood screws approved for ledger installations. These structural screws are proprietary, smaller in diameter than the larger bolts and lags, easier to install because they often obviate the need for pilot holes, and drive with light duty battery-operated drivers. Structural screws are tested to capacities rivaling larger commodity fasteners. Typically, structural screws range from about ¼"-⅜" in diameter, and they are better sized than the ½" and ⅝" lag screws for conditions requiring attachment into the 1½ face of a stud or framing member.

The present invention improves on a known deck spacer also invented by, and patents issued to, the present inventor, viz., the spacer shown in U.S. Pat. Nos. 8,087,207 and 6,945,004, each of which is incorporated in its entirety by reference herein.

The foregoing patents each teach a spacer directed for use in the same manner as the present invention, but each also lack structure making the spacer suitable for use with a variety of primary and secondary fasteners, as well as use with sealants and/or adhesives adding strength and preventing water and debris intrusion.

BRIEF SUMMARY OF THE INVENTION

The present invention is an improved board spacer, typically employed as a deck spacer, used to secure and space a ledger board to a structure while maintaining the ledger a predetermined distance from the structure.

Among the many objects of the invention, it is a principal object to provide a board spacer that can be sold individually, yet still be suited for use with a variety of primary (center) and secondary (circumferential) fasteners.

The improved board spacer of the present invention accommodates a wide range of proprietary structural wood screws and commodity fasteners that vary by diameter. It does so by including a hole in the center of the spacer that accepts keyed bushings with a variety of cylindrical hole diameters. The new spacer design also provides opposing conical and cylindrical countersink profiles to accept common wood screws and newly developed, structurally rated hexagonal head screws which are approved for installing joist hangers and other structural connectors. Additionally, the new design has sealant wells to constrain sealant on both sides of the spacer.

The inventive board spacer benefits retailers, users, and material specifiers. Retailers can rely on a single spacer to be compatible with their selection of deck ledger fasteners, simplifying ordering, inventory, and reducing required shelf space. Users will benefit from increased selection of fastener choices. Engineers and other materials specifiers can select their preferred fasteners based on test data and availability, for both primary and secondary fasteners to ensure reliable connections and local availability.

The present invention further provides multiple solutions to increasing the spacing width between a ledger and a deck board by providing several spacing accessories for use in conjunction with the deck spacer that enable the user to widen the space between the deck ledger and structural framing member.

In achieving the principal object of the invention, a second, corollary object is also achieved, namely that of being economical in manufacture, marketing, and sale.

BRIEF DESCRIPTION OF SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
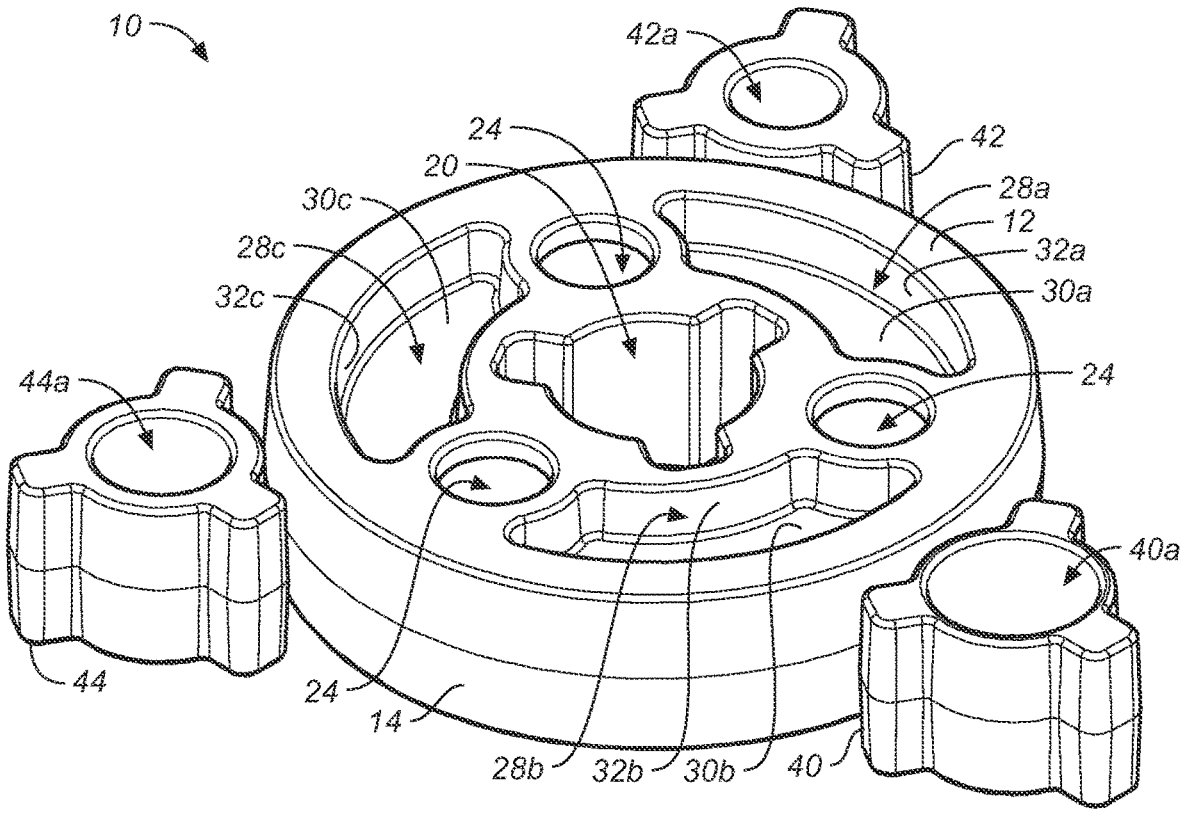
FIG. 1 is an upper front perspective view of the deck spacer of the present invention.
Figure 3:
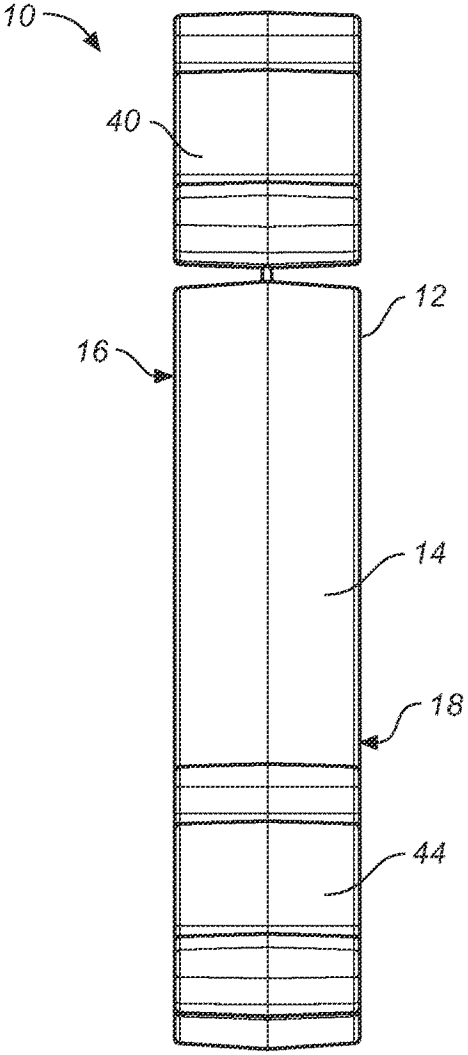
FIG. 3 is a side view in elevation thereof.
Figure 2:
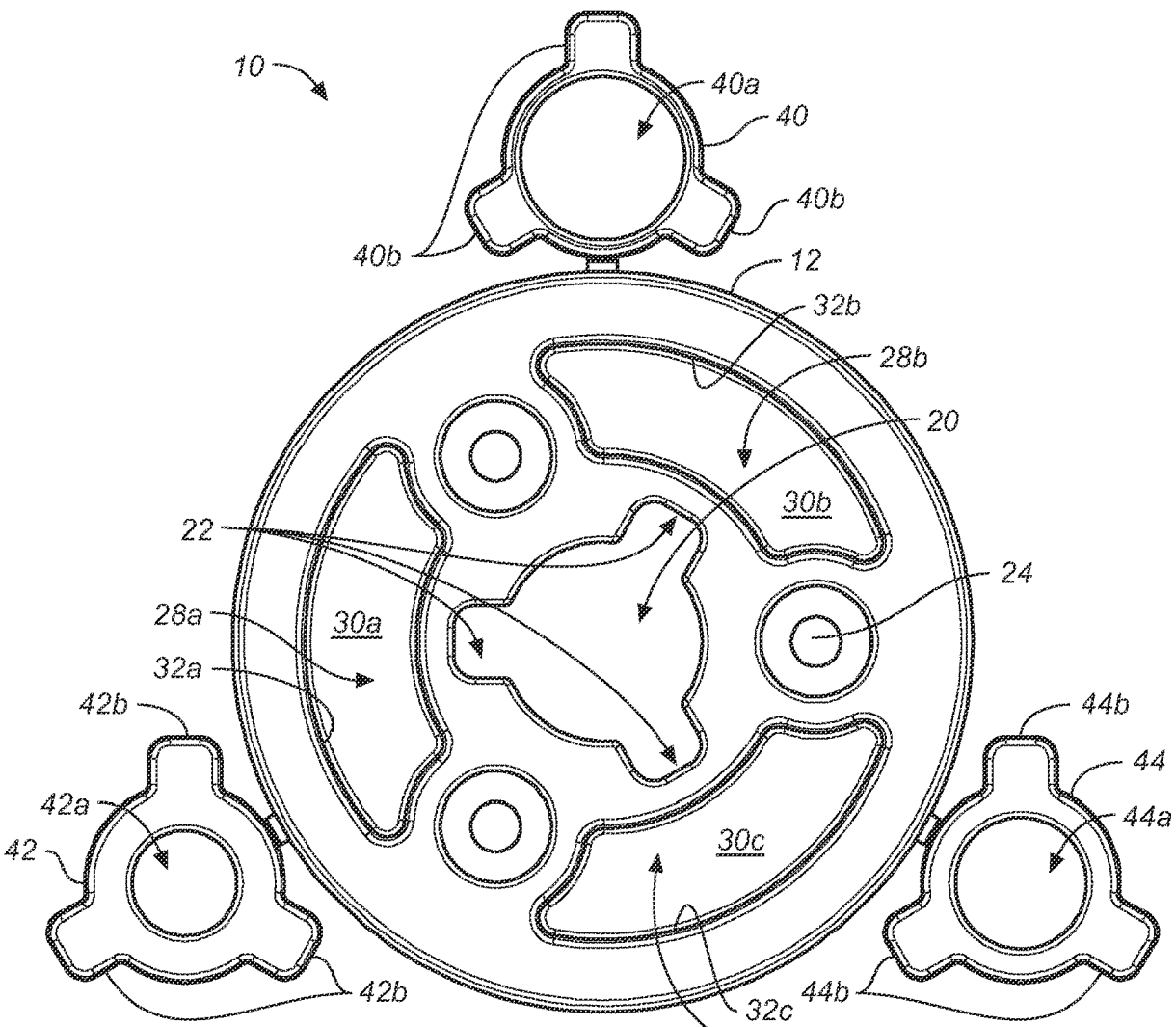
FIG. 2 is a front view in elevation thereof.
Figure 4:
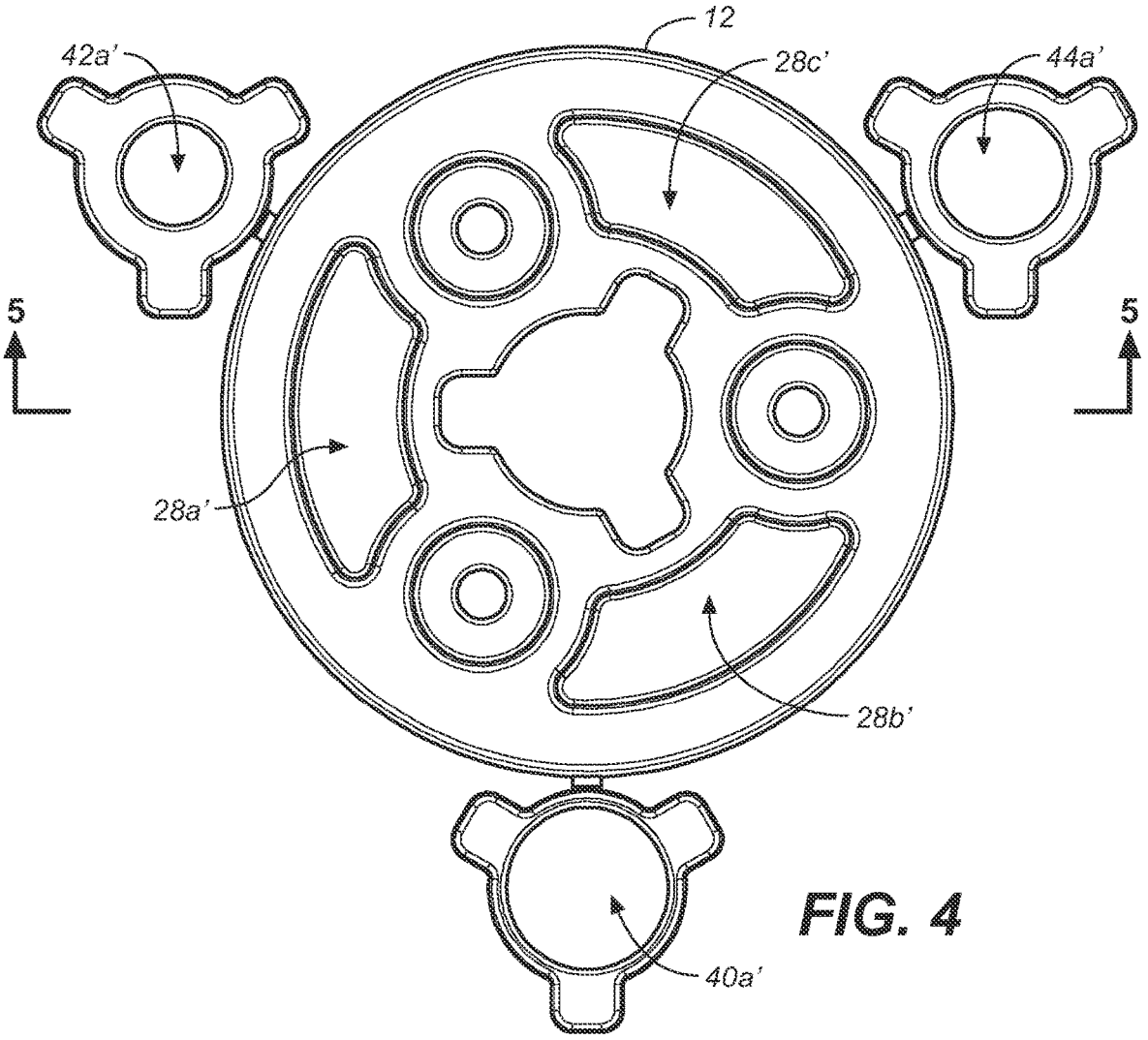
FIG. 4 is an inverted rear view in elevation thereof.
Figure 5:
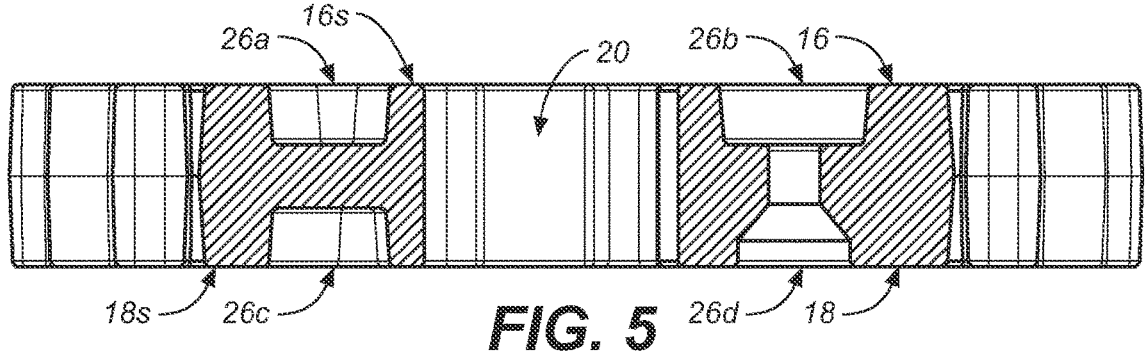
FIG. 5 is a cross sectional side view taken along section line 5-5 of FIG. 4.

Referring first to FIGS. 1 through 7, wherein like reference numerals refer to like components in the various views, there is illustrated therein a new and improved deck board spacer, and more broadly useful as a board spacer generally, which is generally denominated 10 herein. The views, collectively, show that in an embodiment the deck board spacer ("deck spacer" or "board spacer" herein) includes a generally cylindrical low-profile, generally solid disc body 12 having a generally circular circumferential outer side 14. The disc body is typically manufactured in a plastic injection molding process and is thus a unitary piece of polymeric material. Alternatively, the disc body may be made using plastic or metal blocks for CNC machining.

The cylindrical/circular geometry, while preferable, is not essential, and the disc body may be configured in any of a number of suitable geometries. The thickness of the disc is typically less than an inch (2.54 cm) and is selected to provide spacing for air circulation while maintaining the essential structural integrity of the connection between a ledger board and the attached structure.

Each of the front side 16 and the back (rear) side 18 are substantially planar, though each side is characterized in having several substantially mirror image depressions, recesses, wells, and through holes. For instance, and most importantly, the spacer includes a center hole 20 having at least one—and in embodiments, a plurality of—evenly-spaced radially-extending voids or spokes 22 that function as the female elements for a keyed bushing (to be described more fully below). In embodiments, a single spoke may be employed, as it alone may be sufficient when cooperating with a male bushing element to prevent rotation and translation of the bushing, or a plurality of spokes may be provided in an evenly spaced arrangement, e.g., three spokes at roughly 120 degrees apart, as shown in the view. However, this selection of the number and placement of the "negative" keying element is non-limiting, as any number of elements, one or greater, might be employed, and spacing needn't be entirely even or consistent.

The disc front and rear sides next include through holes 24 for secondary fasteners, i.e., those secondary to a bolt adapted for passage through the through hole of one or any of a number of keyed bushings that may be inserted into the center hole 20, as more fully described below. These holes are generally substantially smaller (i.e., have a substantially smaller inner diameter) than the center hole and the keyed bushing through holes, and on each side they include countersunk or a counterbored holes comprising a recess shaped (cylindrical or conical) and sized to fit the head of a fastener such that the surface of the fastener head sits flush with the front or rear surfaces, 16*s*, 18*s*, respectively, of the disc when fully tightened (see FIG. 5). Advantageously, the countersinks/counterbores may be of different sizes and configurations, 26*a*, 26*b*, 26*c*, 26*d*, adapted to fit most commonly used deck screws, hex head screws, and other fasteners.

Next, the deck spacer of the present invention includes adhesive/sealant cavities or wells—28*a*, 28*b*, 28*c* on the front side—and 28*a*N, 28*b*N, 28*c*N on the rear side. The wells on the front side are of the same dimensions, as are those on the rear side; however, the wells on the rear side are slightly smaller in their perimeter dimension than those on the front side. These wells provide a pocket for containing a volume of flowable sealant or adhesive with bonding surfaces at the bases of the wells 30*a*, 30*b*, 30*c*, 30*a*N, 30*b*N, 30*c*N and sides 32*a*, 32*b*, 32*c*, 32*a*N, 32*b*N, 32*c*N to contain and constrain the adhesive such that it does not migrate between the front or rear surfaces 34, 36 of the spacer and the structural element to which the spacer is attached. Again, the sealant wells will also serve to receive element and features of shear transfer accessories.

In embodiments, the deck spacer may include three distinct center keyed bushings 40, 42, 44, having variously sized through holes 40*a*, 42*a*, 44*a*, and a plurality of radiating male spokes sized and spaced for complementary insertion into the center hole 20 and the female voids 22 disposed around the peripheral of the center hole. Each keyed bushing has a thickness substantially, if not precisely, matching the thickness of the disc body immediately surrounding the keyed bushing when inserted in the center hole.

The figures show the bushings coupled to the outer side 14 (the periphery) of the disc body 12, typically though injection molding at the time of manufacture. Such an evenly spaced configuration is somewhat arbitrary and intended for packaging economy and to promote product recognition; it is not a structural feature essential to the spacer when in use. For the same purposes, the bushings could be spaced in any of a number of ways or sold entirely separately from the disc body itself. Further, while three bushings are shown, the only limits to the number possible are set by what is commercially practical—that is, there are only so many different sizes of fasteners used in construction for connecting the structural members of decks to structural framing members.

When in use, the builder simply selects a keyed bushing adapted to fit the primary and secondary fasteners of his or her choice, installs the appropriate center keyed bushing, and orients the disc body with the countersink/counterbore on the outboard side of the spacer (the side facing away from the member to which the spacer will first be secured).

Figure 6:
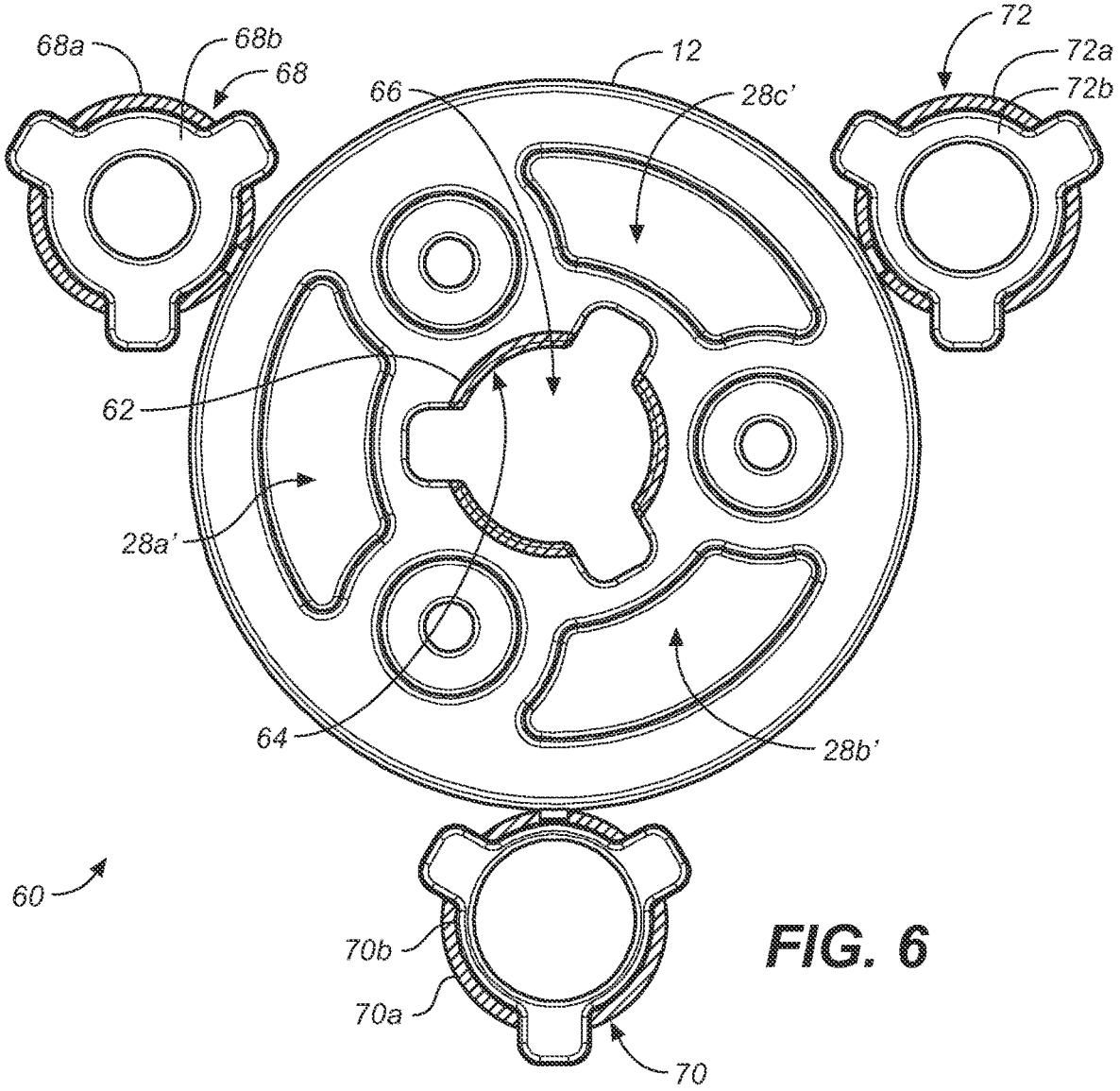
FIG. 6 is a front view in elevation showing an alternative embodiment with bushing retention structure.

Referring next to FIG. 6, there is shown in a front elevational view an alternative embodiment 60 of the inventive apparatus, here showing that the swappable keyed bushing can be provided with an integral surface feature structure that cooperates with a complementary surface feature 62 on the interior wall 64 of the center hole 66 (the latter surface feature not shown). For instance, each of the variable bushings 68, 70, 72 may include a low profile circumferential (equatorial) ridge 68*a*, 70*a*, 72*a* disposed about the surfaces of each of the annular bushing body portions 68*b*, 70*b*, 72*b*. The ridge dimensions are sized for a snap-fit coupling with a female channel or groove 64 circumferentially disposed around the interior wall of the center hole and sized to fit all of the variably sized bushings.

Note should be made that because the deck spacer is screwed to the ledger, the spacer engages the primary fastener as the ledger deflects from vertical loads placed on the deck. The spacer, being harder than the wood, increases the load capacity of the connection by effectively increasing the side member thicknesses and dowel bearing strengths of the side members. For this reason, it is critical that the center hole of the bushing be properly sized to the diameter of the fastener and thus why having a selection of center hole bushings is particularly advantageous.

Figure 7:
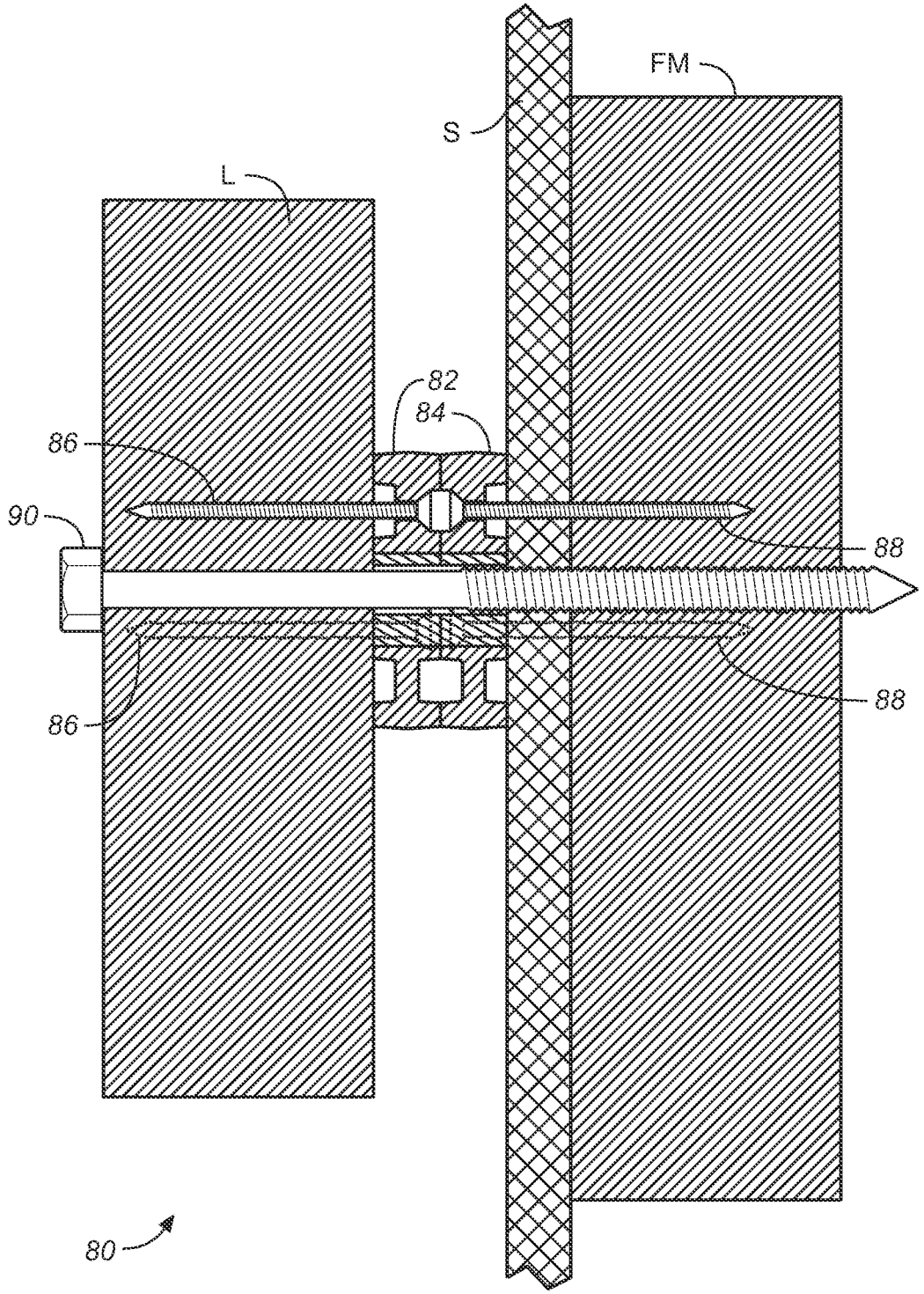
FIG. 7 is a cross-sectional side view in elevation showing the deck spacer installed in a stacked configuration.

FIG. 7 is a cross-sectional side view showing the inventive deck spacer installed in a stacked configuration 80. This constitutes a new method for stacking spacers while maximizing load bearing capacity, which is accomplished by: (1) temporarily attaching the ledger in the desired location; (2) drilling pilot holes through ledger and into supporting structure; (3) centering one (or more) spacers over the pilot holes on the ledger and installing secondary fasteners through spacer(s) and into the ledger as typically installed; (4) centering one or more spacers over pilot holes in the supporting structure and installing with secondary fasteners through the spacer(s) and into the supporting structure. The connection is then completed with a primary fastener. When completed, this combination features first and second stacked spacers 82, 84, the first 82 screwed directly to the ledger L with suitably sized secondary fasteners 86, the second 84 attached to the building framing member FM through siding S (shown generically to cover the myriad kinds contemplated), also using suitably sized secondary fasteners 88. A primary fastener 90, such as a lag screw or bolt is employed to complete this stacked spacer assembly. As will be appreciated, sealant is advantageously employed between each spacer and the wood structure to which it is attached.

This method doubles the penetration of the secondary fasteners and effectively increases the thickness and dowel bearing strength of the mains and side members. This also minimizes primary fastener deflection and increases the load bearing capacity of the connection. This is useful in stucco and exterior foam sheathing applications where extra distance is needed for clearance between the ledger and the supporting structure framing.

Figure 8:
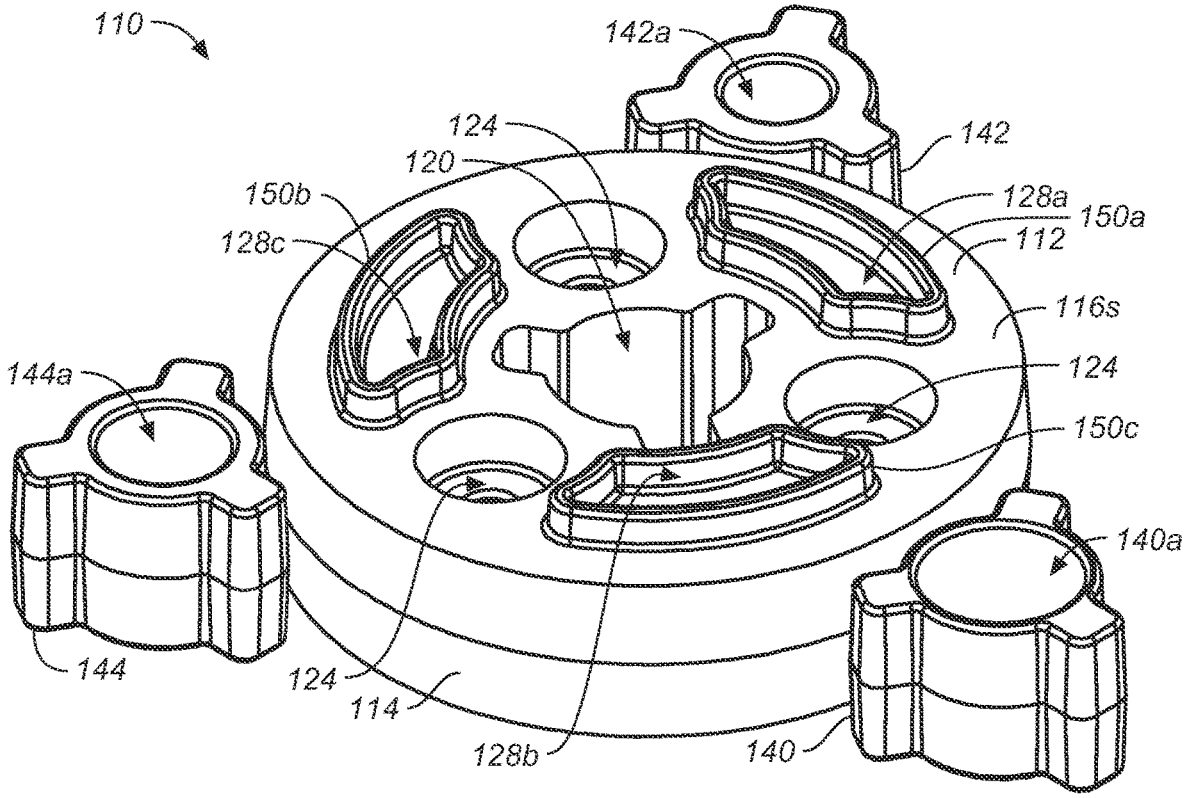
FIG. 8 is an upper front perspective view showing an alternative embodiment of the deck spacer of the present invention, in this instance showing a coupling spacer.
Figure 10:
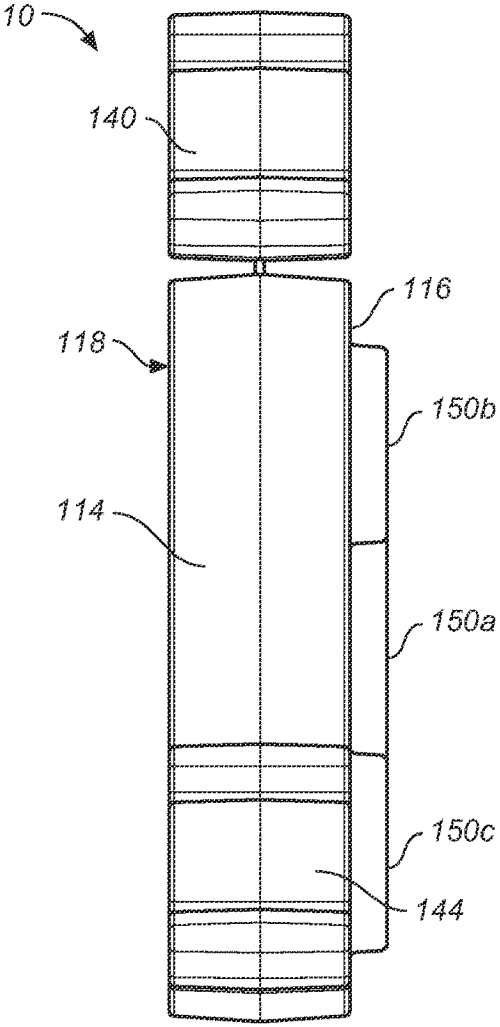
FIG. 10 is a side view in elevation thereof.
Figure 9:
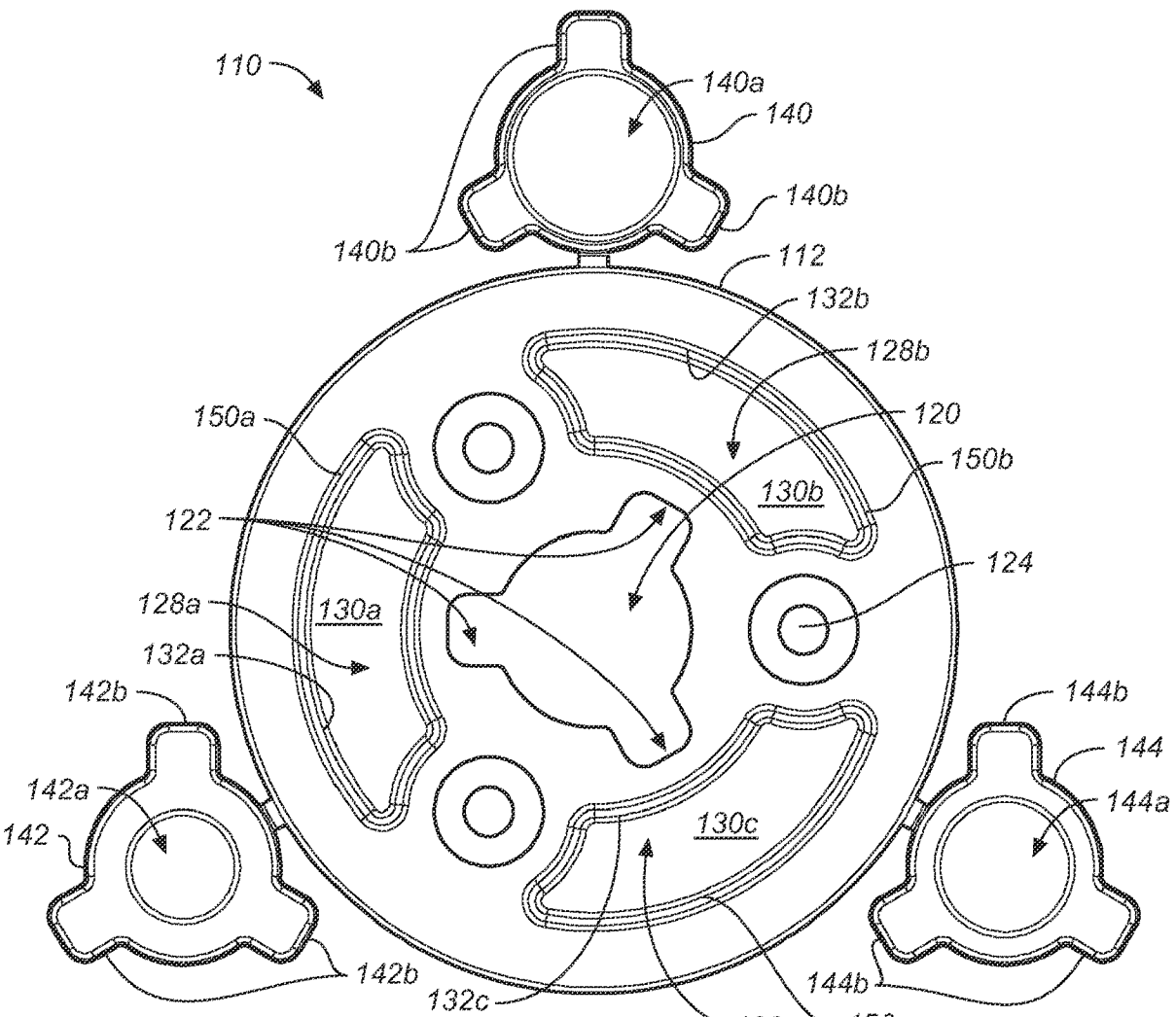
FIG. 9 is a rear view in elevation thereof.
Figure 11:
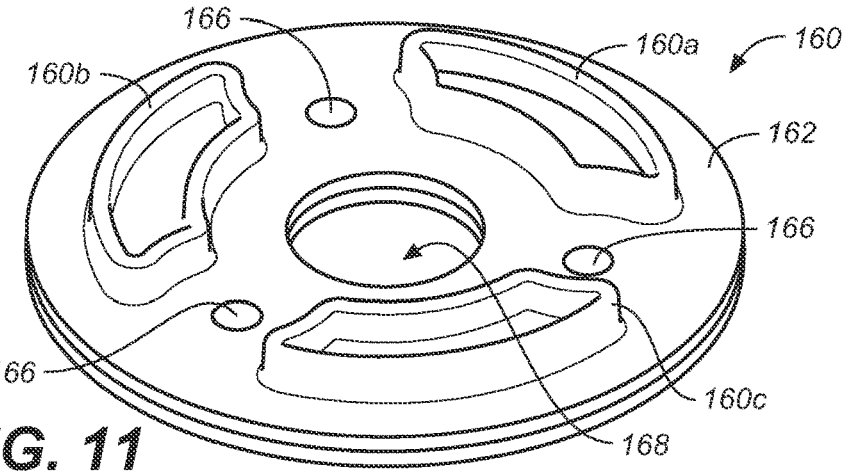
FIG. 11 is an upper front perspective view of a reinforced shim as used in the present invention.
Figure 12:
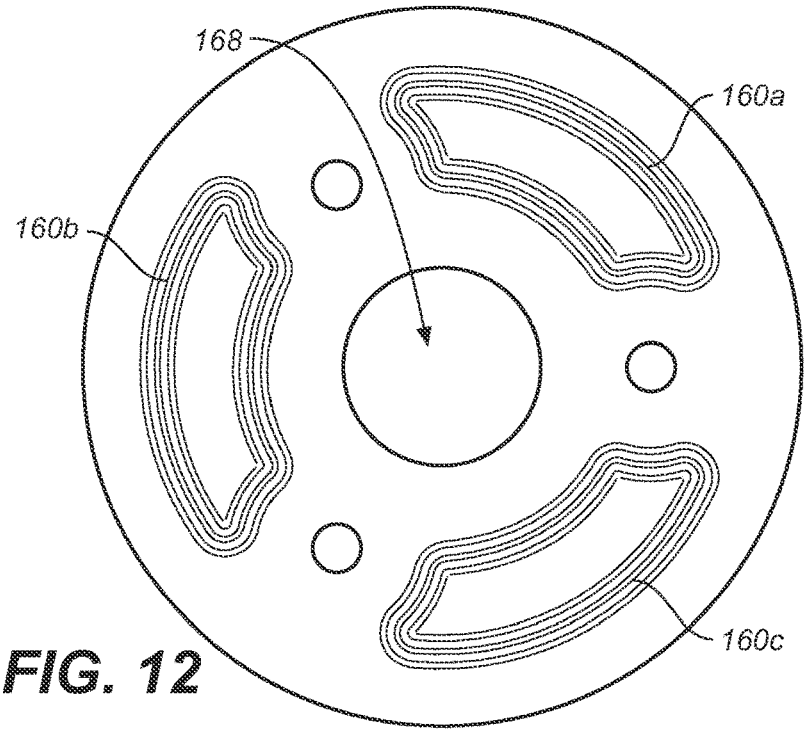
FIG. 12 is a top plan view thereof.
Figure 13:
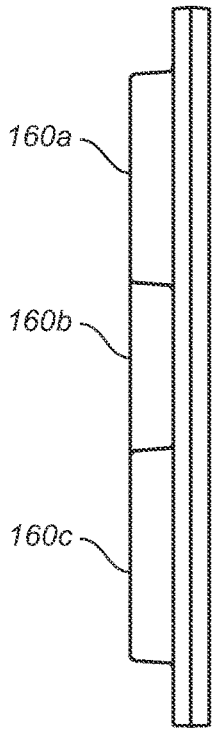
FIG. 13 is a side view in elevation thereof.
Figure 14:
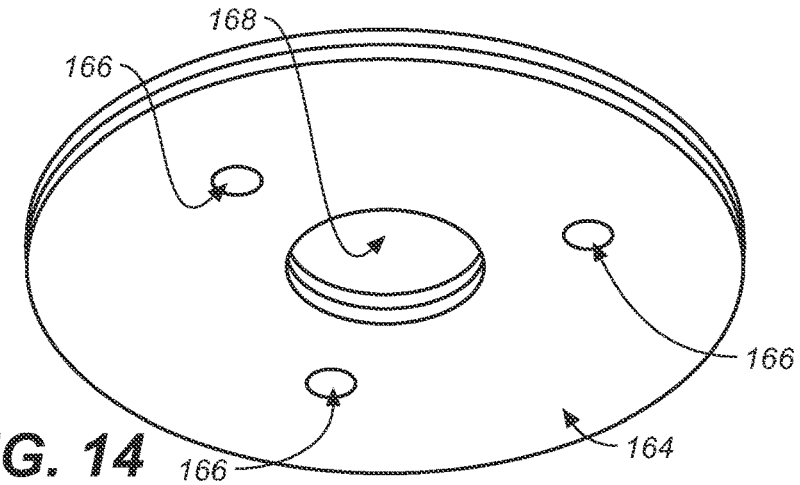
FIG. 14 is a lower rear perspective view thereof.
Figure 15:
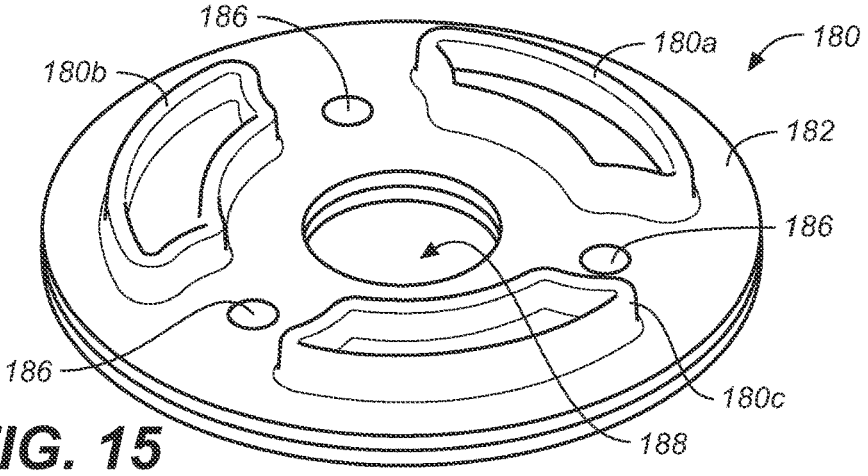
FIG. 15 is an upper front perspective view of a reinforcing coupler as used in the present invention.
Figure 16:
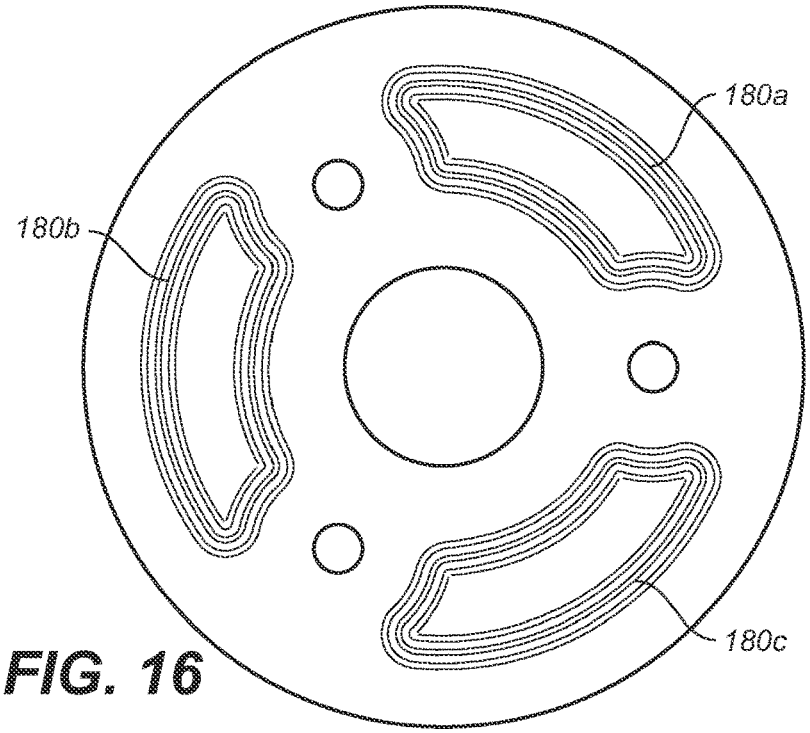
FIG. 16 is a top plan view thereof.
Figure 17:
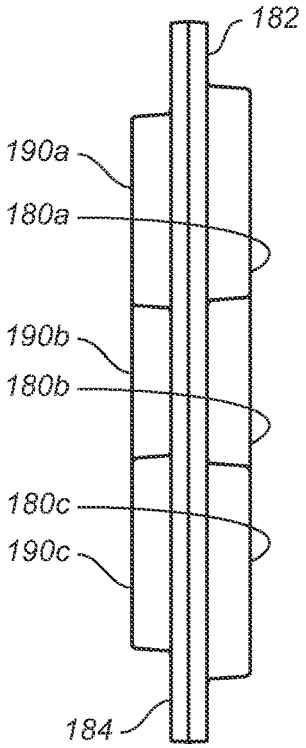
FIG. 17 is a side view in elevation thereof.
Figure 18:
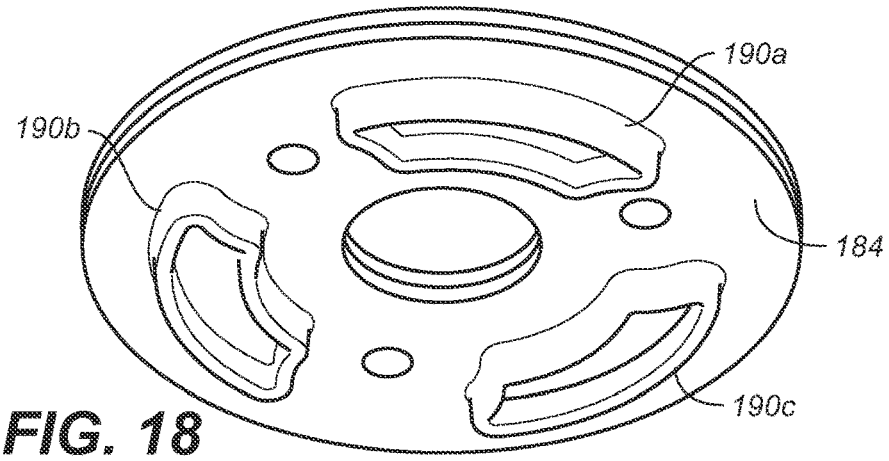
FIG. 18 is a lower rear side perspective view thereof.
Figure 19:
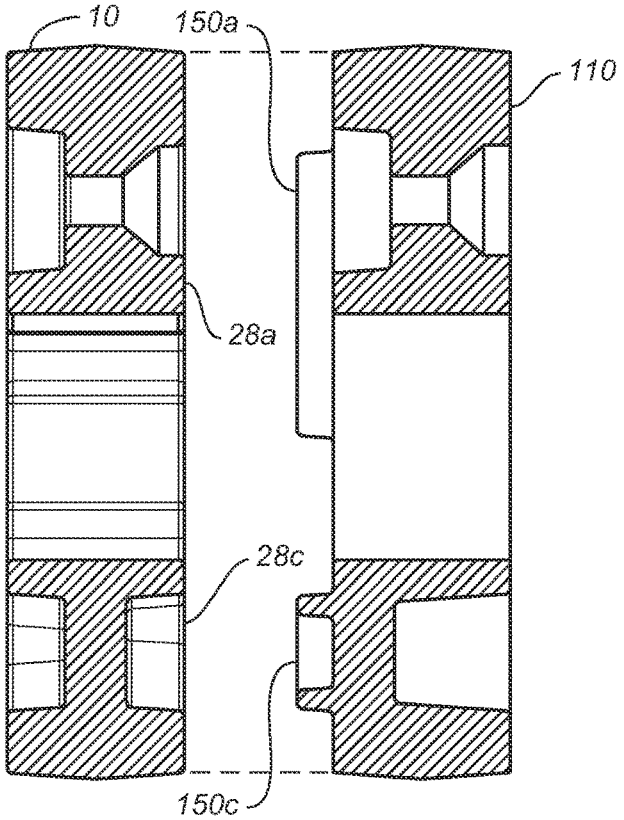
FIG. 19 is a cross-section side view in elevation showing a deck spacer being coupled with a coupling spacer.
Figure 20:
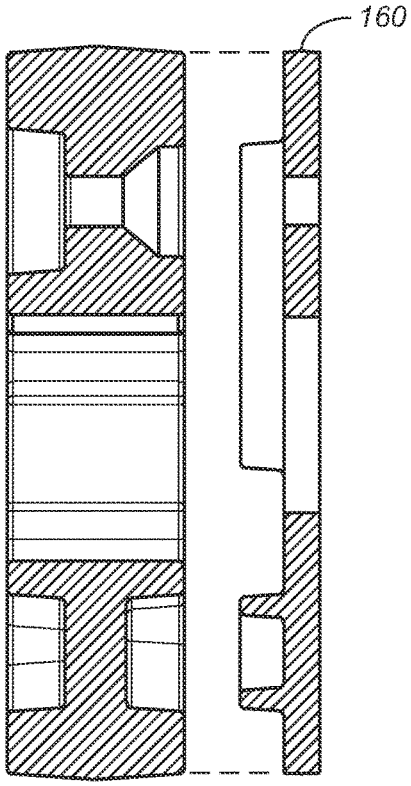
FIG. 20 is a cross-sectional side view in elevation of a reinforced shim being coupled with a coupling spacer.
Figure 21:
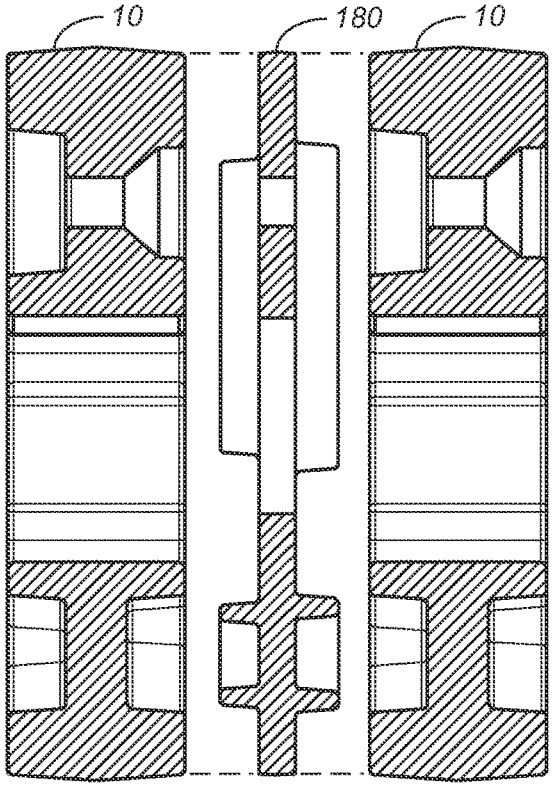
FIG. 21 is a cross-sectional side view in elevation showing a reinforcing coupler connecting with a coupling spacer.

Referring next to FIGS. 8 through 10, there is illustrated another embodiment of the inventive deck spacer described above. It may be referred to herein as a "coupling spacer," and it may be used either instead of, or in conjunction with, the earlier described embodiment of the deck spacer, as it is provided with surface features that enhance coupling strength and improved resistance to sheer forces when installed. The coupling spacer is generally denominated 110 herein.

As with the earlier described embodiment, this alternative embodiment includes a generally cylindrical low-profile disc body 112 having a circular circumferential outer side 114. Again, the cylindrical/circular geometry is not essential, and the disc body could take other shapes. Dimensions are essentially identical to the deck spacer.

Each of the front side 116 and the back (rear) side 118 are substantially planar, though each side is characterized in having nearly mirror image pluralities of depressions, recesses, wells, and through holes, and as will be discussed more fully below, the front side includes elevated perimeter rims around the adhesive/sealant cavities.

The coupling spacer includes a center hole 120 having one or more radially-extending voids or spokes 122 which function as the female elements for a keyed bushing (to be described more fully below). In embodiments, a single spoke may be employed, as it alone may be sufficient when cooperating with a male bushing element to prevent rotation and translation of the bushing, or a plurality of spokes may be provided in an evenly spaced arrangement, e.g., three spokes at roughly 120 degrees apart, as shown in the view. The selection of the number and placement of the "negative" keying element is non-limiting.

The disc front and rear sides next include through holes 124 for secondary fasteners. These holes have a substantially smaller inner diameter than the center hole, and on each side they include countersunk or a counterbored holes comprising a recess which is shaped and sized to fit the head of a fastener such that the surface of the fastener head sits flush with the front or rear surfaces, 116*s*, 118*s*, respectively, of the disc when fully tightened.

Advantageously, the countersinks/counterbores may be of different sizes and configurations, 126*a*, 126*b*, 126*c*, 126*d*, adapted to fit most commonly used deck screws, hex head bolts, and other fasteners.

Next, the coupling spacer includes adhesive/sealant cavities or wells—128*a*, 128*b*, 128*c* on the front side—and 128*a*N, 128*b*N, 128*c*N on the rear side. The purpose and function, as described above, is to provide a recess for containing a flowable sealant or adhesive. The bonding surfaces are at the bases of the wells 130*a*, 130*b*, 130*c*, 130*a*N, 130*b*N, 130*c*N and sides 132*a*, 132*b*, 132*c*, 132*a*N, 132*b*N, 132*c*N to contain and constrain the adhesive such that it does not migrate between the front or rear surfaces 134, 136 of the spacer and thereby get between the spacer and the structural element to which the spacer is attached.

In embodiments, the coupling spacer includes three distinct center keyed bushings 140, 142, 144, having variously sized through holes 140*a*, 142*a*, 144*a*, and a plurality of radiating male spokes sized and spaced for complementary insertion into the center hole 120 and the female voids 122 disposed around the peripheral of the center hole.

As noted, FIGS. 8-10 show an alternative embodiment of the deck spacer, i.e., a coupling spacer, and in this embodiment the coupling features relate to male elements 150*a*, 150*b*, 150*c*, which comprise elevated perimeters (raised projections) that extend upwardly from the coupling spacer surface 116*s* and are sized to insert snugly but readily into the larger well openings 28*a*, 28*b*, 28*c* on the front side 16 of the deck spacer 10 or a complementary coupling spacer. When coupling to the deck spacer, the front side of the coupling spacer is approximated to the front side of the deck spacer and the male elements inserted into the well openings of the deck spacer. When the lag bolt and secondary fasteners are installed, the compression of the two spacer bodies effectively locks the coupling spacer in its mated connection to the deck spacer. Further, the wells on the coupling spacer also accept adhesive/sealant compound, and thereby contribute to unifying the deck spacer and coupling spacer, whereby shear strength is substantially increased.

FIGS. 8-10 also show the keyed bushings coupled to the outer side 114 (the periphery) of the disc body 112. Three bushings are once again shown, but there is no specific number of bushings essential to the inventive apparatus, and commercial practicality will inform manufacture and sales.

Referring now to FIGS. 11-14, there is shown a reinforced shim 160, which cooperates with the deck spacer or coupling spacer to provide a spacing system or an options kit for increasing spacing between a ledger board and a structural member. Some deck installations call for slight increases in the ledger board gap, and the reinforcing shim includes male projections, 160*a*, 160*b*, 160*c*, on its front side 162, which insert into the larger wells on either the deck spacer 10 or the coupling spacer 110. When so inserted, the reinforced shim increases the spacing between the ledger board and structural member and provides a planar rear surface 164 to engage either. It further includes through holes 166 that align with the through holes 24 on the deck spacer or the through holes 124 on the coupling spacer so as to pass secondary fasteners selected according to the countersink provided. Likewise, the center hole 168 aligns with the center holes 20, 120 of either apparatus. Again, the wells formed and defined within the raised projections accommodate adhesive/sealant and thus contribute to unifying the reinforced shim with the spacers and to increasing shear strength when installed.

Finally, the board spacing options kit next includes selective use of a reinforcing coupler 180, which essentially duplicates the features of the reinforced shim, but for the inclusion of male elements 180*a*, 180*b*, 180*c* on the front side and slightly smaller male elements 190*a*, 190*b*, 190*c* on the rear side 184 of the shim. It further includes through holes 186 for passing secondary fasteners, a center hole 188.

System elements provide flexibility and options in selecting spacer components best fitted for the installation and other construction materials at hand while never compromising structural integrity.

The above disclosure is sufficient to enable one of ordinary skill in the art to practice the invention and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A board spacer system, comprising:

a solid disc body having a front side and a rear side, a center hole, and a plurality of circumferential through holes surrounding said center hole, wherein said center hole includes at least one radially-extending void that serves as a female element for a complementary keyed bushing, and wherein each of said front and rear sides have a plurality of wells recessed from a front and rear surface, respectively, of said disc body, said wells configured to receive a volume of flowable adhesive sealant material during installation; and at least one swappable keyed bushing sized for insertion in said center hole, each of said keyed bushings having a male element complementary to said radially-extending void and having a bushing through hole with a diameter different from other keyed bushings if a plurality of keyed bushings are used.

2. The board spacer system of claim 1, wherein said disc body has a thickness of less than one inch.

3. The board spacer system of claim 1, wherein there are at least two radially-extending voids.

4. The board spacer system of claim 3, wherein there are at least three spaced-apart, radially-extending voids.

5. The board spacer system of claim 4, wherein said radially-extending voids are evenly spaced apart.

6. The board spacer system of claim 1, wherein said circumferential through holes are adapted for a passage of fasteners secondary to and smaller than a primary bolt adapted for passage through said center hole of one of said keyed bushings.

7. The board spacer system of claim 1, wherein said center hole of said disc body and each of said keyed bushings include complementary integral surface features to create a snap-fit coupling of any of said keyed bushings inserted into said center hole.

8. The board spacer system of claim 1, wherein said plurality of wells on said rear sides of said disc body are configured as a female element shaped to accept male insertion elements on said front side of said disc body or on a shear transfer accessory.

9. The board spacer system of claim 8, wherein said plurality of wells on said rear sides of said disc body taper inwardly from said surface of said rear side and each of said plurality of wells on said front side of said disc body further include an elevated rim sized and configured to insert into said wells in said rear side so as to couple a first board spacer with a second, adjoining board spacer.

10. The board spacer system of claim 8, further including a reinforced shim having a planar rear surface and a plurality of raised male projections configured for insertion into said plurality of wells on said rear side of said disc body, said reinforced shim further including through holes that align with said plurality of through holes in said disc body.

11. The board spacer system of claim 10, wherein said raised male projections form adhesive wells on said reinforced shim.

* * * * *